United States Patent [19]

Hare

[11] 3,994,095

[45] Nov. 30, 1976

[54] SAFETY WINDOW

[76] Inventor: Terence G. Hare, 22600 Middlebelt G. 11, Farmington, Mich. 48024

[22] Filed: July 18, 1975

[21] Appl. No.: 597,026

[52] U.S. Cl. ..... 49/356; 49/394; 49/506

[51] Int. Cl.[2] ..... E05F 9/00; E06B 3/12

[58] Field of Search ..... 49/356, 381, 394, 501, 49/506, 507

[56] References Cited

UNITED STATES PATENTS

| | | | |
|---|---|---|---|
| 1,856,569 | 5/1932 | Larsen | 49/356 |
| 2,352,029 | 6/1944 | Soule | 49/356 X |
| 2,399,169 | 4/1946 | Crawford | 49/501 |
| 2,589,768 | 3/1952 | Brownie | 49/356 |
| 2,745,149 | 5/1956 | Etling | 49/506 |
| 3,452,482 | 7/1969 | Durham, Sr. et al. | 49/506 |

FOREIGN PATENTS OR APPLICATIONS

| | | | |
|---|---|---|---|
| 32,095 | 1/1912 | Sweden | 49/356 |

*Primary Examiner*—Philip C. Kannan

*Attorney, Agent, or Firm*—Barnes, Kisselle, Raisch & Choate

[57] ABSTRACT

The method of converting a jalousie-type window to a safety-type window, the steps comprising removing the hinges for each of the panels except one, removing the operating mechanism, interconnecting the panels to make a single unitary window, and adding operating means for activating and locking the single panel.

6 Claims, 11 Drawing Figures

10
11
13
14
25
26
27
28
29
30
31
32
33
34
35
5
6
8

SAFETY WINDOW

This invention relates to safety windows for mobile homes and the like.

BACKGROUND OF THE INVENTION

In mobile homes which were produced sometime ago, it was common to utilize jalousie-type windows. A severe disadvantage of such windows is that they would not permit egress in the case of fire.

Among the objects of the present invention are to provide a method and construction for converting such jalousie-type windows readily and economically to safety windows.

SUMMARY OF THE INVENTION

In accordance with the invention, a jalousie-type window is converted to a safety-type window by removing the hinges for each of the panels except one, removing the operating mechanism, interconnecting the panels to make a single unitary window, and adding operating means for activating and locking the single panel.

DESCRIPTION

Figure 1:
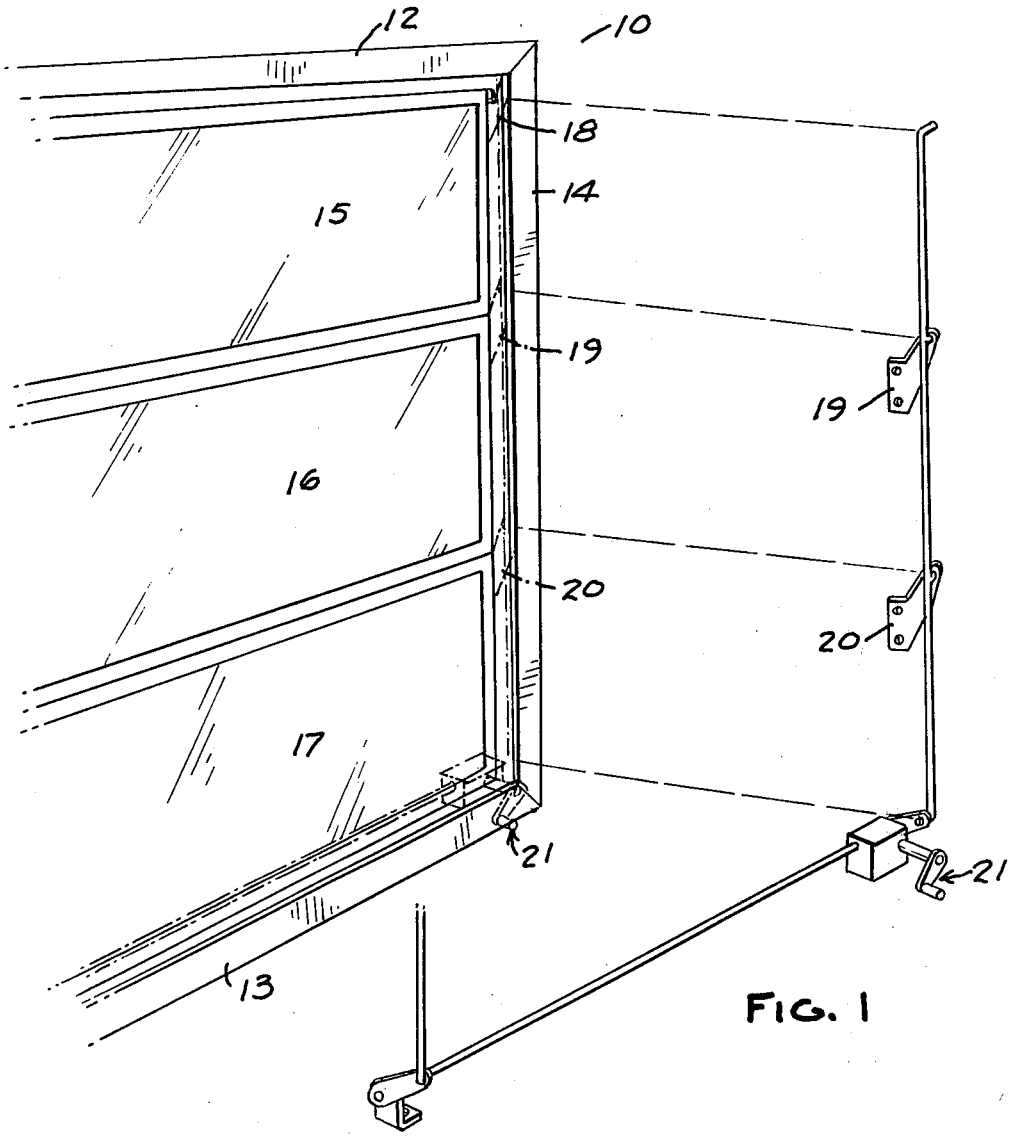
FIG. 1 is a fragmentary perspective view of a conventional jalousie-type window such as used in mobile homes showing the parts that are removed to convert the same to a saftey window.

Referring to FIG. 1, the wall 10 of a mobile home or the like conventionally includes a frame 11 having horizontal top and bottom portions 12, 13 and side portions 14. The jalousie window conventionally comprises panels 15, 16, 17 pivotally connected to the vertical frame portions 14 by hinges 18, 19, 20 and an operating mechanism 21 including a crank for moving the hinges and simultaneously opening and closing the panels.

In accordance with the invention, the hinges of all the panels except top panel 15 are removed and the operating mechanism 21 is removed.

Figure 2:
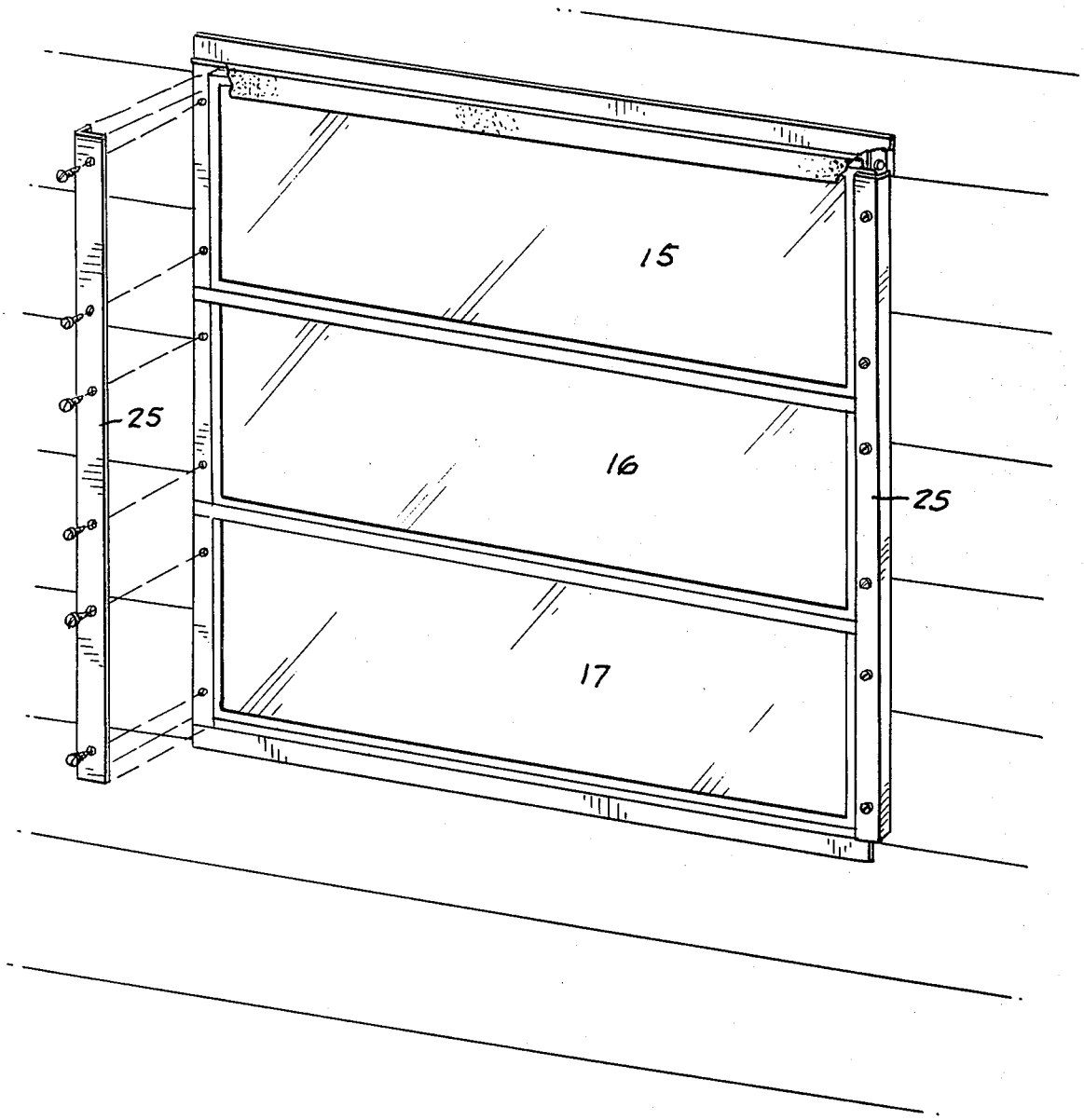
FIG. 2 is a fragmentary perspective view showing parts broken away in the conversion from a jalousie-type to a safety window.

As shown in FIG. 2, angles 25 are utilized to convert the panels 15, 16, 17 to a unitary window by screws extending through the angle 25 into the panels. In this manner, a single window is provided that is hinged at its upper end by the hinges 18.

Figures 3, 4, 5, 6:
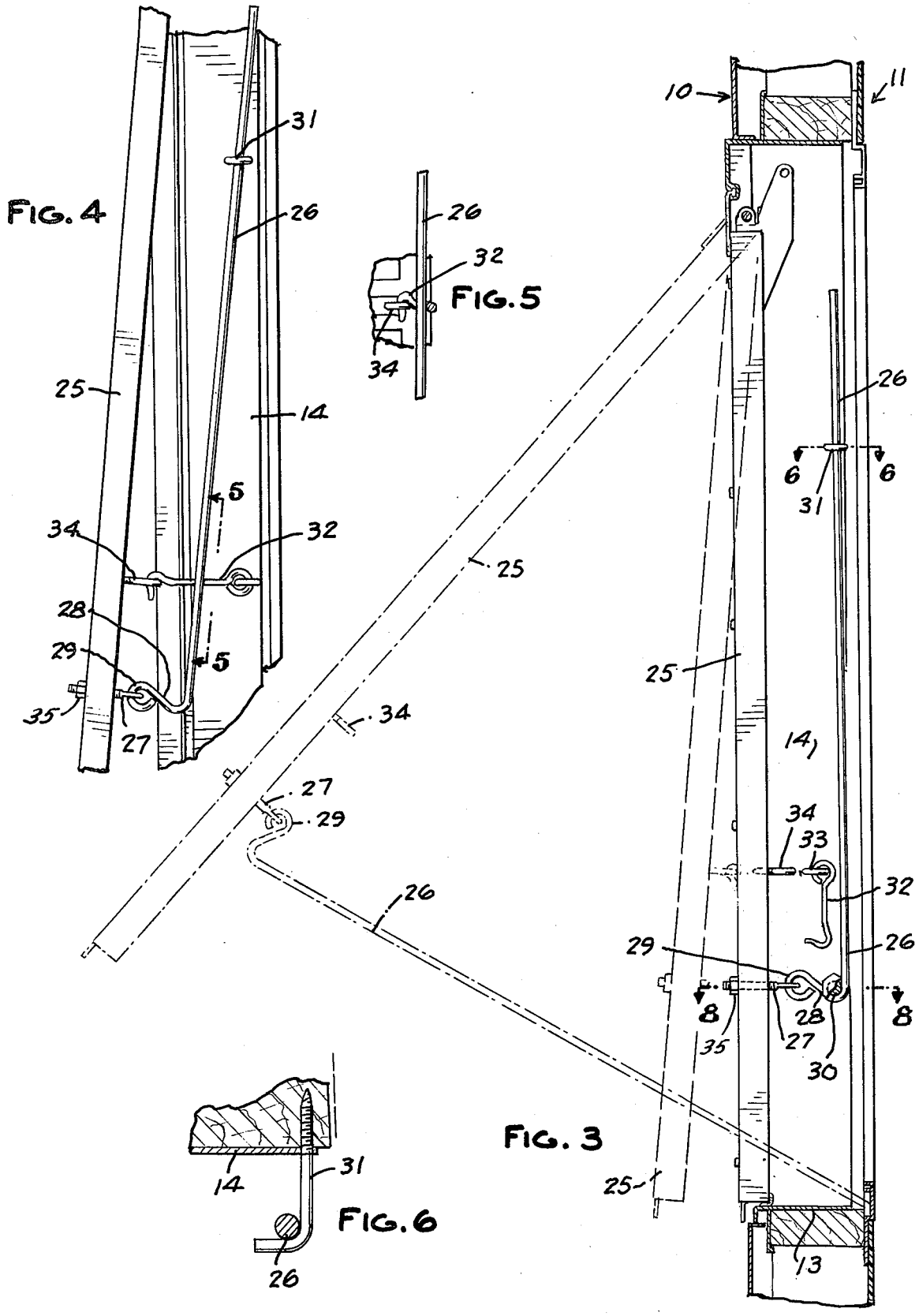
FIG. 3 is a part sectional vertical view of the safety window embodying the invention.
FIG. 4 is a fragmentary view similar to FIG. 3 showing the parts in a different operative position.
FIG. 5 is a fragmentary sectional view taken along the line 5—5 in FIG. 4.
FIG. 6 is a fragmentary sectional view taken along the line 6—6 in FIG. 3.
Figure 7:
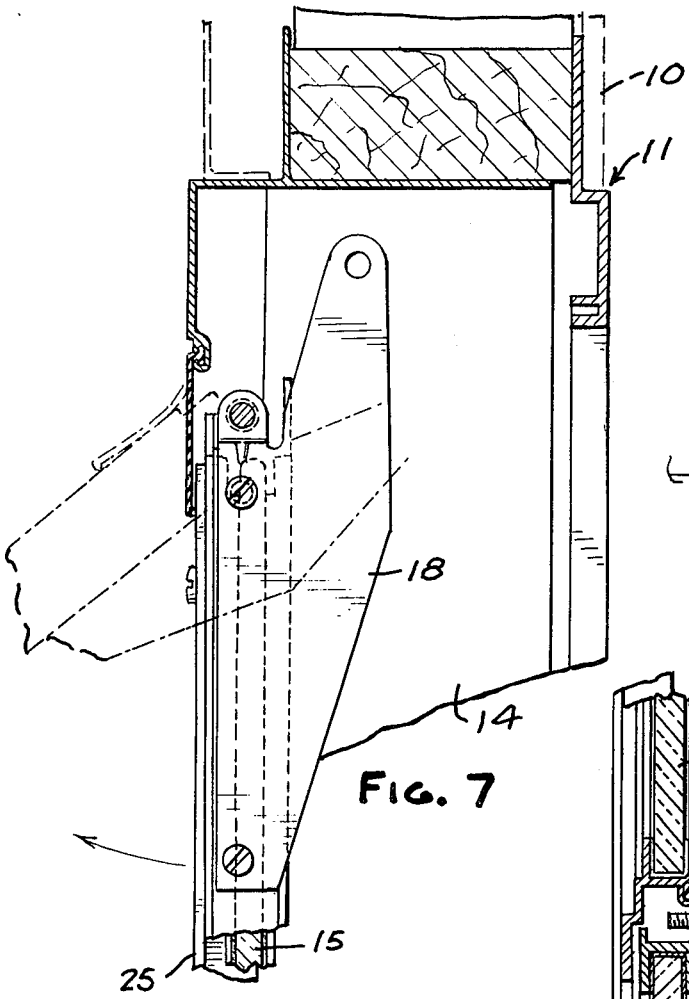
FIG. 7 is a vertical sectional view of the upper portion of the window taken along the line 7—7 in FIG. 11.
Figure 8:
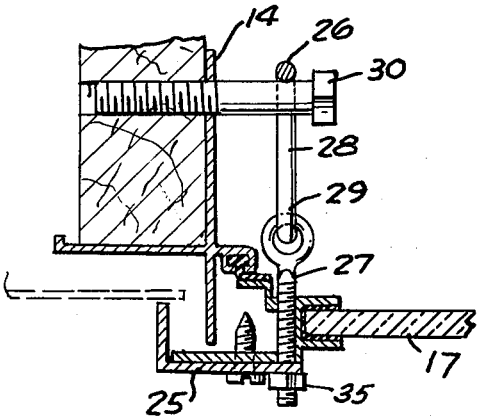
FIG. 8 is a fragmentary sectional view taken along the line 8—8 in FIG. 3.
Figure 9:
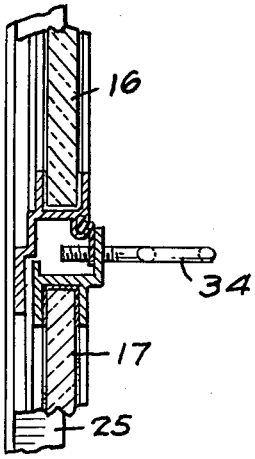
FIG. 9 is a framentary sectional view taken along the line 9—9 in FIG. 11.
Figure 10:
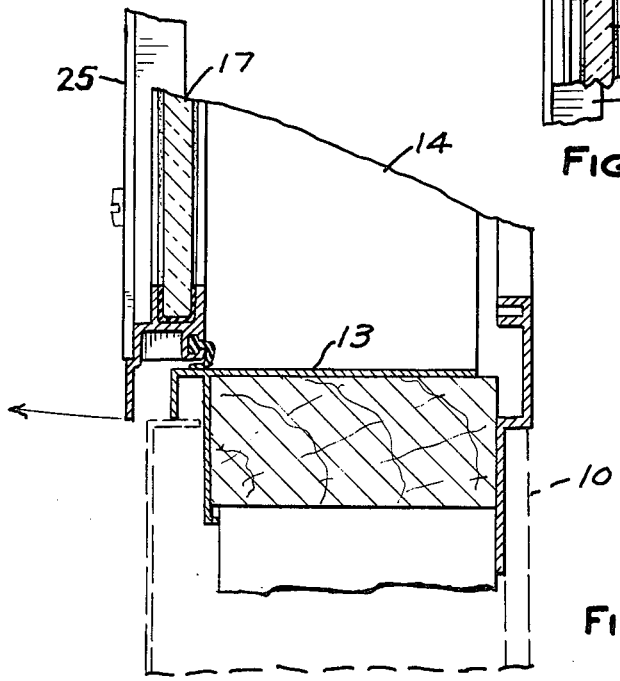
FIG. 10 is a fragmentary sectional view taken along the line 10—10 in FIG. 11.
Figure 11:
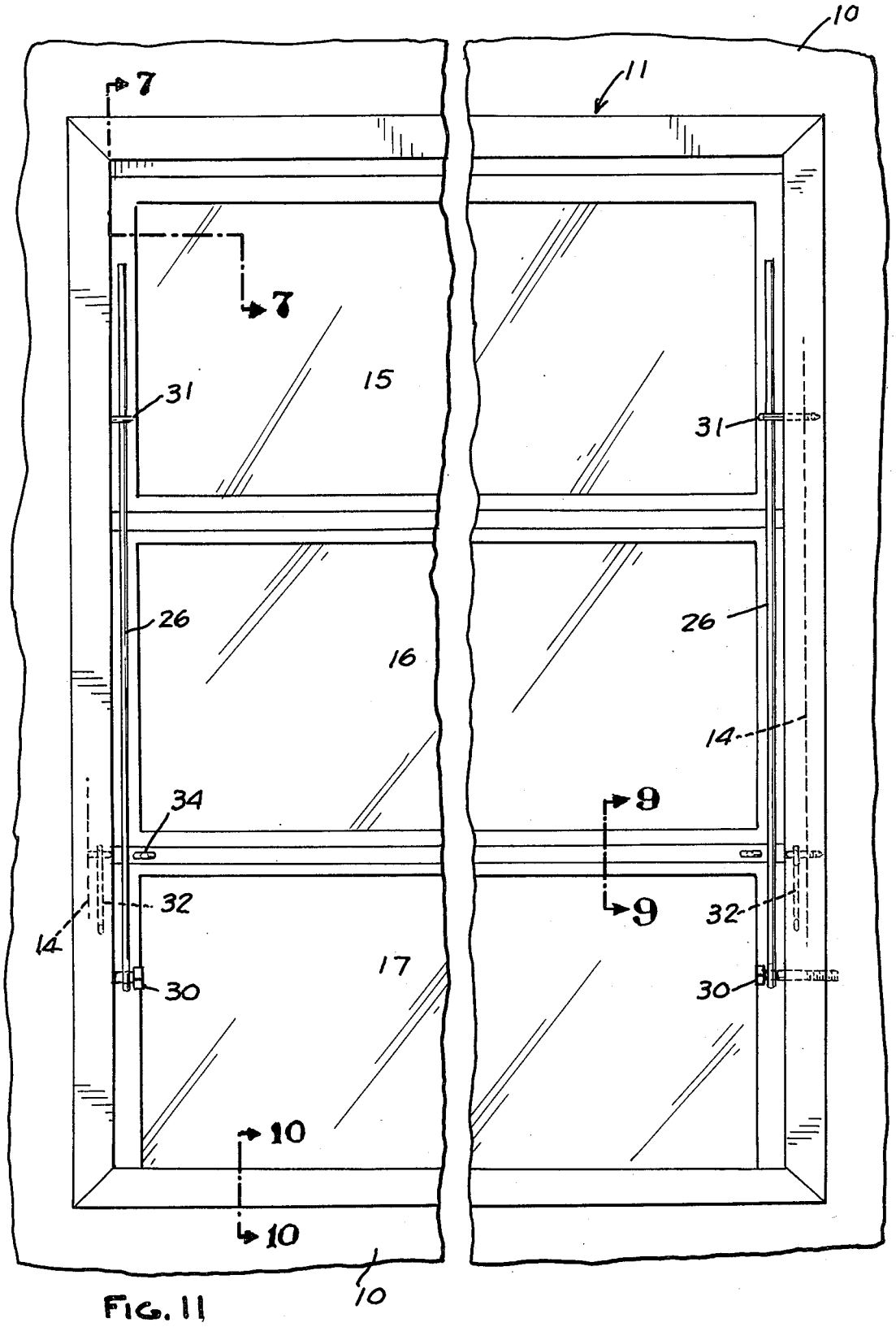
FIG. 11 is an elevational view of a safety window embodying the invention.

An operating rod 26 is then pivoted adjacent each edge of the panel through a universal connector 27. The rod 26 includes an offset portion 28 having an eye 29 that forms the connection to connector 27. The remainder of the rod 26 is straight so that when the rods are in the position shown in FIG. 3 engaging the base 13 of the frame, the window is held open.

In order to close the window, the rods are grasped, lifted up, then pulled inwardly of the wall 10 and about pins 30 on sides 14 and the upper ends of the rods are hooked behind hooks 31 adjacent the upper part of the sides 14. In this manner the window is closed and maintained in locked position.

Connector 27 is threaded through window panel assembly so the connector 27 can be adjusted by screwing in or out for proper window closing. Then nut 35 is tightened securing proper adjustment.

In order to hold the window in an intermediate opened position, a conventional hook 32 is pivoted by an eye 33 to the side wall 14 for engagement with an eye 34 spaced vertically above a connector 27. When so hooked, the window is held in partially open position. In this position, hooking of each rod 26 behind the hook 31 places tension on the hook 32 to prevent rattling of the window.

I claim:

1. In the method of converting a jalousie-type window to a safety-type window, the steps comprising removing the hinges for each of the panels except one, removing the operating mechanism, interconnecting the panels to make a single unitary window, and adding operating means for activation and locking the single panel.

2. In a jalousie-type window converted to a safety window, the combination comprising a plurality of panels normally hinged to the side of a window opening, angle bars fastened to the panels and interconnecting the panels to form a single window, an actuating rod pivoted to said single window adjacent its lower end, said rod having an offset portion adjacent the pivot point to the window, a pin on the window opening engaging said offset portion when the window is closed, and a hook vertically above said pin and engaging said rod so as to lock said rod and in turn said window in closed position.

3. The combination set forth in claim 2 including an eye fixed to said window and a second hook fixed to said window opening such as to maintain the window in partially open position, said rod extending and engaging said second hook and connected to said first-mentioned hook to provide tension to said second hook and prevent vibration of the window.

4. The combination set forth in claim 2 wherein said pin is positioned such as to tension said rod.

5. In a jalousie-type window converted to a safety window, the combination comprising a plurality of panels normally hinged to the side of a window opening, angle bars fastened to the panels and interconnecting the panels to form a single window, a pair of actuating rods pivoted to said single window adjacent its lower end, each said rod having an offset portion adjacent the pivot point to the window a pin on the window opening and individual to each said rod engaging said offset portion when the window is closed, and a hook individual to each said rod vertically above said pin and engaging said rod so as to lock said rod and in turn said window in closed position.

6. The combination set forth in claim 4 including an eye individual to each said rod fixed to said window and a second hook fixed to each side of said window opening such as to maintain the window in partially open position, each said rod extending and engaging its respective second hook and connected to said first-mentioned hook to provide tension to said second hook and prevent vibration of the window.

* * * * *